US008517499B2

(12) United States Patent
Takano et al.

(10) Patent No.: US 8,517,499 B2
(45) Date of Patent: Aug. 27, 2013

(54) INKJET PRINTING HEAD AND INKJET PRINTING APPARATUS

(75) Inventors: Katsuhiko Takano, Yokohama (JP); Makoto Shihoh, Yokohama (JP); Shoji Kanemura, Sagamihara (JP); Hiroyasu Nomura, Inagi (JP); Katsumasa Nishikawa, Tokyo (JP); Shigeo Takenaka, Kamakura (JP); Manabu Sueoka, Yokohama (JP); Junji Yasuda, Kawasaki (JP); Noriyuki Chino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 496 days.

(21) Appl. No.: 12/277,925

(22) Filed: Nov. 25, 2008

(65) Prior Publication Data

US 2009/0141063 A1 Jun. 4, 2009

(30) Foreign Application Priority Data

| | | |
|---|---|---|
| Nov. 30, 2007 | (JP) | 2007-309698 |
| Nov. 30, 2007 | (JP) | 2007-309700 |
| Nov. 30, 2007 | (JP) | 2007-311415 |
| Nov. 4, 2008 | (JP) | 2008-283334 |

(51) Int. Cl.
*B41J 29/377* (2006.01)

(52) U.S. Cl.
USPC ..... 347/18

(58) Field of Classification Search
USPC ..... 347/18; 165/104.19, 104.21
See application file for complete search history.

(56) References Cited

U.S. PATENT DOCUMENTS

| | | | | |
|---|---|---|---|---|
| 5,017,941 | A | 5/1991 | Drake | |
| 5,697,428 | A * | 12/1997 | Akachi | 165/104.21 |
| 6,074,035 | A | 6/2000 | Irizawa et al. | |
| 6,350,013 | B1 * | 2/2002 | Scheffelin et al. | 347/49 |
| 7,236,644 | B2 | 6/2007 | Suzuki et al. | |
| 2003/0150931 | A1 * | 8/2003 | Drury et al. | 239/102.1 |
| 2009/0096838 | A1 | 4/2009 | Chino et al. | |
| 2009/0141062 | A1 * | 6/2009 | Takano et al. | 347/18 |

FOREIGN PATENT DOCUMENTS

| | | | |
|---|---|---|---|
| JP | 62-10145 | A | 1/1987 |
| JP | 63-99957 | U | 9/1988 |
| JP | 03-166954 | A | 7/1991 |
| JP | 04-15537 | U | 2/1992 |
| JP | 8-276574 | | 10/1996 |
| JP | 8-276575 | | 10/1996 |
| JP | 2002-142113 | A | 5/2002 |
| JP | 2007-136727 | A | 6/2007 |
| JP | 2007-168112 | A | 7/2007 |

OTHER PUBLICATIONS

Notification of Reasons for Refusal dated Dec. 4, 2012, in Japanese Application No. 2008-283334.

* cited by examiner

*Primary Examiner* — Julian Huffman
(74) *Attorney, Agent, or Firm* — Fitzpatrick, Cella, Harper & Scinto

(57) ABSTRACT

A temperature rise of a head due to a printing operation with a higher speed and a higher density is suppressed. To realize this, an inkjet printing head is provided in which a plurality of printing element substrates having an ejection opening array consisting of a plurality of ejection openings for ejecting ink are arranged on a support plate in a direction of the ejection opening array. The support plate includes therein a heat pipe and a flow path through which cooling liquid is flowed.

10 Claims, 20 Drawing Sheets

INKJET PRINTING HEAD AND INKJET PRINTING APPARATUS

BACKGROUND OF THE INVENTION

1. Field of the Invention

The present invention relates to an inkjet printing apparatus that ejects ink to perform a printing operation and an inkjet printing head used for the printing apparatus.

2. Description of the Related Art

Conventionally, the inkjet printing apparatus achieves a reduced running cost for color images and also can have a smaller size. Thus, the inkjet printing apparatus has been widely used for computer-related output devices and has been commercialized.

In recent years, in order to realize the printing of high-definition images with a higher speed, a printing head having a wider printing width (or an ejection opening array having a longer length) also has been desired. Specifically, a printing head having a length of 4 inches to 13 inches also has been required.

The printing head having a longer length and a higher speed as described above causes an increased energy inputted to the printing head to consequently cause an increased temperature rise of the printing head during a printing operation. This consequently requires measures for preventing factors deteriorating the printing reliability (e.g., fluctuation in the ejection amount for the respective pages, unstable ejection at a high temperature, a deteriorated continuous printing operation).

Conventionally, the printing head has been cooled by methods such as air cooling from the outside of the printing head or a cooling pipe attached to the printing head.

In the conventional method, the completed printing head is externally attached with a heat pipe or a radiation member. Thus, a disadvantage has been caused where a printing element substrate as a heat source cannot be provided in the close vicinity of the heat pipe. The externally-attached heat pipe also causes a limited area at which the heat pipe contacts with the printing head, thus causing a poor heat transfer efficiency between the printing head and the heat pipe. Some conditions for executing the printing operation may provide, even in the conventional configuration, sufficient cooling and soaking effects. However, the conventional configuration is disadvantageous when the printing head having a longer length and a higher density is used to continuously perform a printing operation for a longer time. This is due to that the conventional configuration cannot provide a heat transfer efficiency enough to suppress a defective printing due to an uneven temperature distribution and a temperature rise in the printing head due to the long-time printing.

SUMMARY OF THE INVENTION

In view of the disadvantages of the conventional technique as described above, it is an objective of the present invention to provide an inkjet printing head that has a high printing reliability even when a printing head having a long length and a higher density is used to perform a high-speed printing operation.

In one aspect of the present invention, an inkjet printing head,. including a plurality of ejection openings for ejecting ink, comprises:

a printing element substrate that includes an ejection opening array in which a plurality of ejection openings are arranged and that includes elements for generating thermal energy for allowing ink to be ejected through the plurality of ejection openings;

a support plate for supporting a plurality of the printing element substrates arranged in a direction along which the ejection opening array is arranged;

a passage that is provided in the support plate and that includes a heat pipe in a direction along which the plurality of printing element substrates are arranged; and a flow path for flowing cooling liquid that is provided in the support plate and that is provided in a direction along which the plurality of printing element substrates are arranged, wherein:

the passage and the flow path are provided so as to be adjacent to each other in a direction of a thickness of the support plate, and the passage is provided to be closer to the printing element substrate than to the flow path.

The present invention can suppress the temperature rise of the inkjet printing head and an uneven temperature distribution in the inkjet printing head due to a printing operation with a higher speed and an arrangement of ejection openings with a higher density to prevent the fluctuation in the ejection amount and an ejection failure due to a temperature rise. At the same time, a higher speed and a higher image quality can be both established and the reliability during a continuous printing operation can be remarkably improved.

Further features of the present invention will become apparent from the following description of exemplary embodiments (with reference to the attached drawings).

DESCRIPTION OF THE EMBODIMENTS

Embodiments of the present invention will be described with reference to the drawings. FIG. 1 to FIG. 12 illustrate an inkjet printing head and an inkjet printing apparatus to which the present invention can be applied where a plurality of printing element substrates having an ejection opening array consisting of a plurality of ejection openings for ejecting ink are arranged on a support plate along the direction of the ejection opening array. The following section will describe the entirety and the respective configurations with reference to the drawings.

An inkjet the printing head H1000 shown in FIG. 1 (hereinafter simply referred to as printing head) uses an electrothermal transducer for generating thermal energy for causing film boiling in ink in accordance with an electric signal to perform a printing operation.

Figure 2:
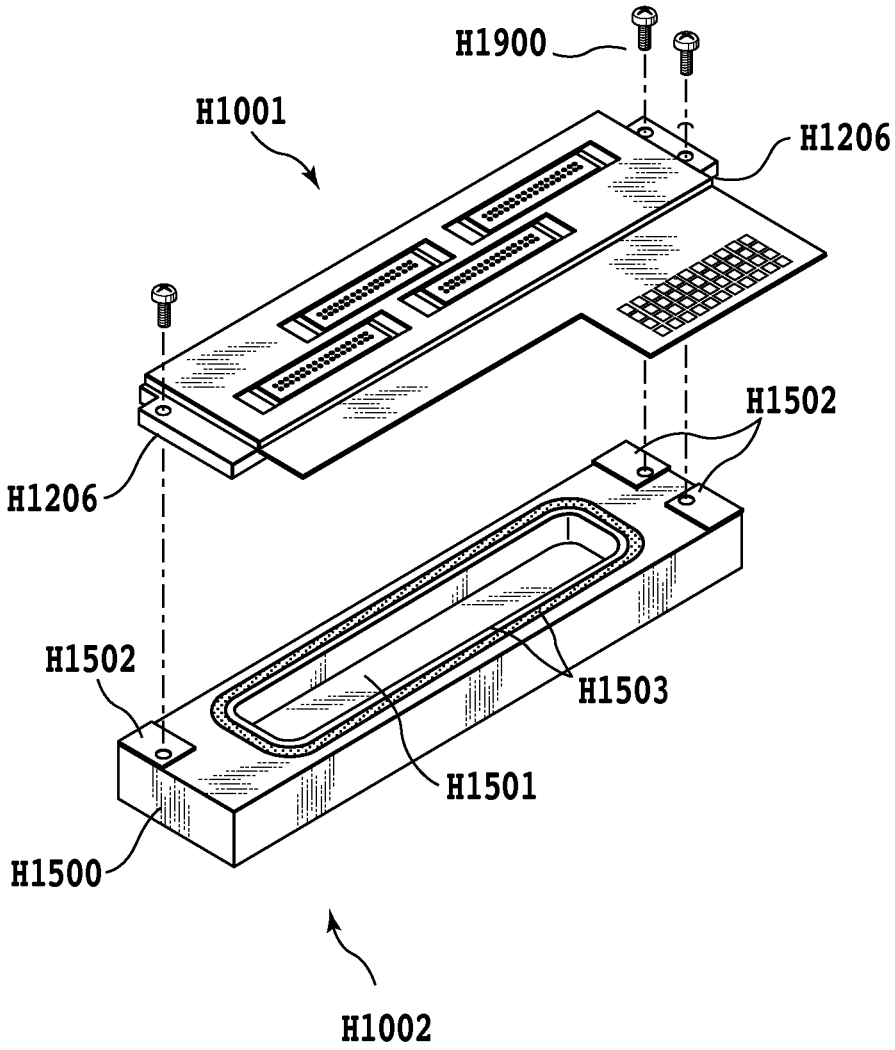
FIG. 2 is an exploded perspective view illustrating the printing head of the present invention.
Figure 3:
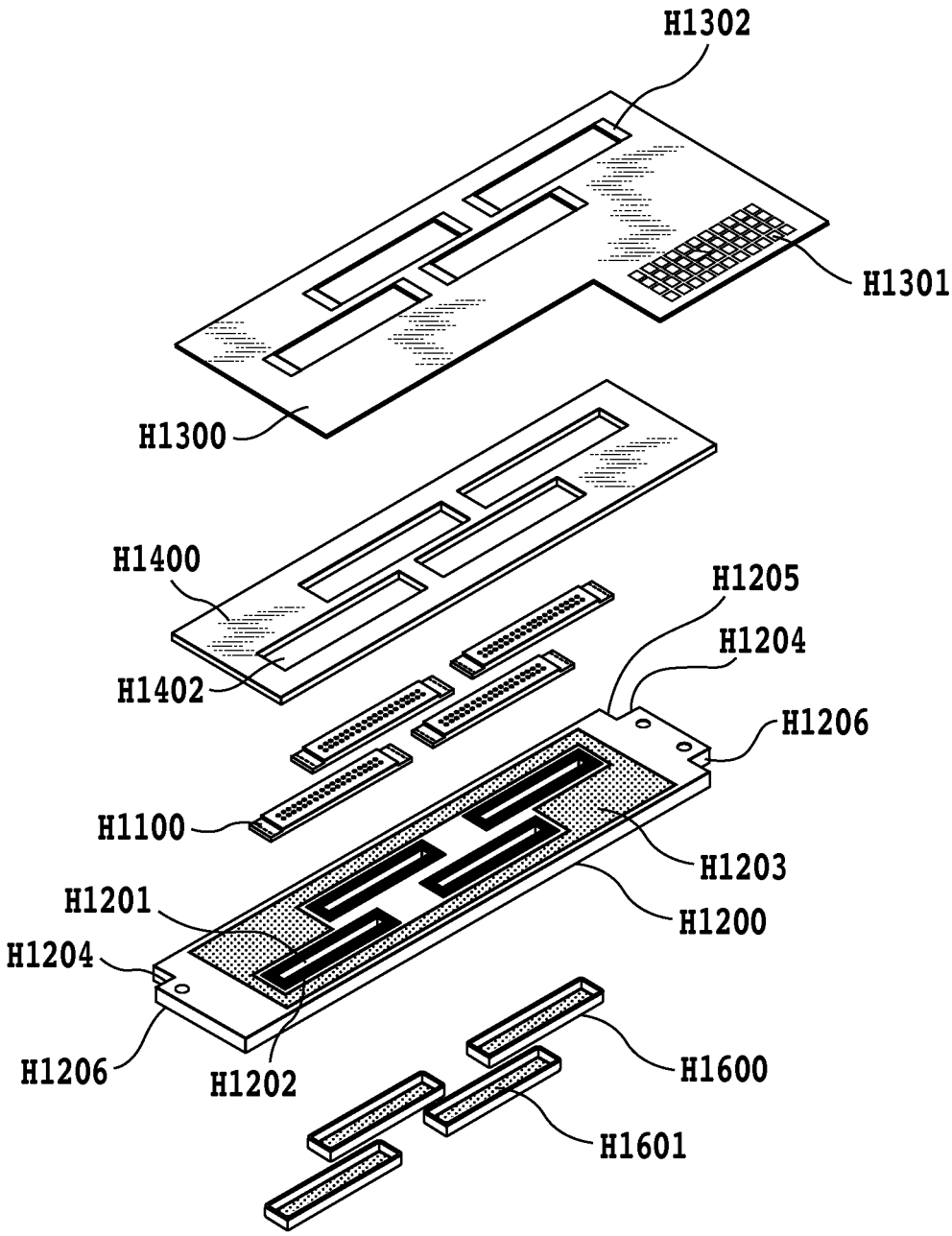
FIG. 3 is an exploded perspective view illustrating a printing element unit.

As shown in the exploded perspective view of FIG. 2, the printing head H1000 is composed of a printing element unit H1001 and an ink supply member H1500 of an ink supply unit H1002. As shown in the exploded perspective view of FIG. 3, the printing element unit H1001 is composed of a printing element substrate H1100, a support plate H1200, an electric wiring substrate H1300, a plate H1400, and a filter member H1600.

Figure 4A:
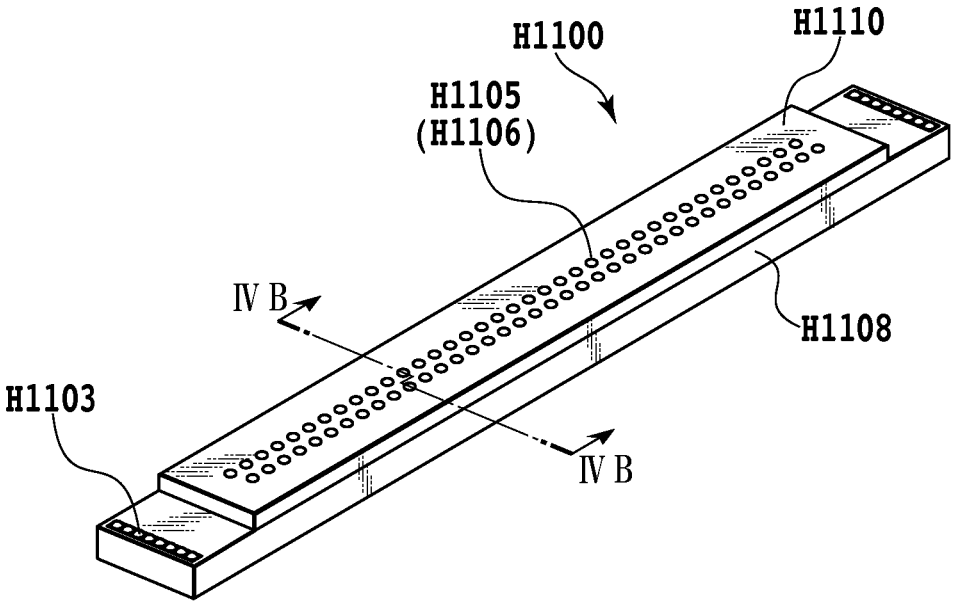
FIG. 4A is a perspective view illustrating a printing element substrate.
Figure 4B:
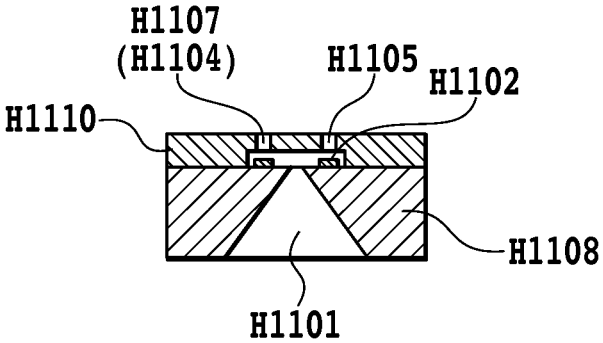
FIG. 4B is a cross-sectional view taken along IVB-IVB in FIG. 4A.

FIG. 4A illustrates the configuration of the printing element substrate H1100. FIG. 4B is across-sectional view taken along IVB-IVB of FIG. 4A. The printing element substrate H1100 is structured so that a thin film of an Si substrate H1108 having a thickness of 0.5 to 1 mm for example is formed. The ink supply opening H1101 is formed as an ink flow path composed of a long groove-like penetration opening. At both sides of the ink supply opening H1101, electric heat conversion elements H1102 are arranged to draw a staggered pattern in one array, respectively. The electric heat conversion element H1102 and an electric wiring such as Al are formed by a film formation technique. An electrode H1103 is provided to supply power to an electric wiring.

The ink supply opening H1101 uses the crystal orientation of the Si substrate H1108 to perform an anisotropic etching. The Si substrate H1108 has thereon the eject opening plate H1110 in which an ink flow path H1104 corresponding to an electric heat conversion element H1102, an ejection opening H1105, and a foaming room H1107 are formed by a photolithography technique. The ejection opening H1105 is provided so as to be opposed to the electric heat conversion element H1102 and allows ink supplied from the ink supply opening H1101 to be ejected by bubbles generated by the electric heat conversion element H1102.

The support plate H1200 is formed by alumina ($Al_2O_3$) material to have a thickness of 0.5 to 10 mm, for example. The material of the support plate is not limited to alumina and also may be made of other materials that have the same linear expansion coefficient as that of the material of the printing element substrate H1100 and that have a thermal conductivity equal to or higher than thermal conductivity of the material of the printing element substrate H1100. The support plate H1200 may be made, for example, of silicon (Si), aluminum nitride (AlN), zirconia, silicon nitride ($Si_3N_4$), silicon carbide (SiC), molybdenum (Mo), or tungsten (W).

The support plate H1200 includes an ink supply opening H1201 (the first ink supply opening) for supplying ink to the printing element substrate H1100. The support plate H1200 is structured so that the ink supply opening H1101 of the printing element substrate H1100 (the second ink supply opening) corresponds to the ink supply opening H1201 of the support plate H1200. The printing element substrate H1100 is fixedly adhered to the support plate H1200 with a high position accuracy. The support plate H1200 has a direction X reference H1204, a direction Y reference H1205, and a direction Z reference H1206 functioning as a positioning reference.

Figure 1:
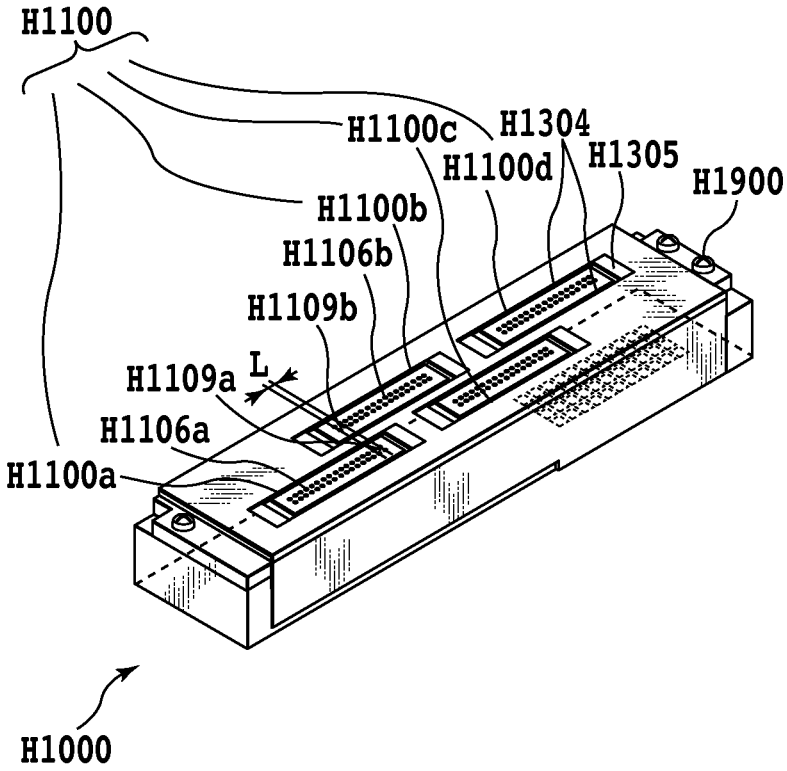
FIG. 1 is a perspective view illustrating the appearance of a printing head of the present invention.

As shown in FIG. 1, the printing element substrates H1100 are arranged to form a staggered pattern on the support plate H1200 to provide the printing of the same color with a wider width. For example, an ejection opening group includes the four printing element substrates H1100*a*, H1100*b*, H1100*c*, and H1100*d* having a length of at least 1 inch arranged in a staggered pattern, thereby achieving the printing of a width of 4 inches.

At ends of the ejection opening groups of the respective printing element substrates, superposed regions (L) are provided at ends of ejection opening groups of ends of neighboring printing element substrates in the staggered pattern and along the printing direction to prevent a gap between printing regions of the respective printing element substrates from being caused. For example, an ejection opening group H1106*a* and an ejection opening group H1106*b* have superposed regions H1109*a* and H1109*b*.

The electric wiring substrate H1300 functions to apply an electric signal for ejecting ink to the printing element substrate H1100 and has an opening section to which the printing element substrate H1100 is provided. A plate H1400 is fixedly adhered to the back face. The electric wiring substrate H1300 has an electrode terminal H1302 corresponding to the electrode H1103 of the printing element substrate H1100 and an external signal input terminal H1301 that is positioned at the end of the wiring and that receives an electric signal from the main body of the printing apparatus.

The electric wiring substrate H1300 is electrically connected to the printing element substrate H1100 by a connection method of, for example, using a wire bonding technique to electrically connect the electrode H1103 of the printing element substrate H1100 to the electrode terminal H1302 of the electric wiring substrate H1300 via a metal wire H1303 (not shown). The electric wiring substrate H1300 is made of a flexible wiring substrate having a wiring having a double structure for example and the top layer is covered by a polyimide film.

The plate H1400 is made of a stainless steel plate having a thickness of 0.5 to 1 mm, for example. The material of the plate is not limited to stainless steel. The plate also may be made of material that has ink resistance and that has a favorable planarity. The plate H1400 has the printing element substrate H1100 fixedly adhered to a support plate H1200 and an opening section through which the printing element substrate is provided and is fixedly adhered to the support plate.

A groove section formed by an opening section H1402 of the plate and the side face of the printing element substrate H1100 is filled with the first sealant H1304 to seal an electric mount section of the electric wiring substrate H1300. An electrode H1103 of the printing element substrate is sealed by the second sealant H1305 to protect an electric connection part from corrosion due to ink and an external impact. The ink supply opening H1201 at the back face of the support plate H1200 is fixedly adhered with a filter member H1600 for removing foreign matter mixed in ink.

The ink supply member H1500 is formed by resin molding for example and includes a common liquid room H1501 and a direction Z reference face H1502. The direction Z reference face H1502 positions and fixes the printing element unit and functions as a reference Z of the printing head H1000.

As shown in FIG. 2, the printing head H1000 is completed by coupling the printing element unit H1001 to the ink supply member H1500. The coupling is performed in the manner as described below. The opening section of the ink supply member H1500 and the printing element unit H1001 are sealed by the third sealant H1503 to seal the common liquid room H1501. The printing element unit H1001 is positioned and fixed to the reference Z H1502 of the ink supply member by a screw H1900 for example. The third sealant H1503 preferably has ink resistance, cures at a room temperature and is flexible so as to endure a difference in the linear expansion between different materials.

Figure 5:
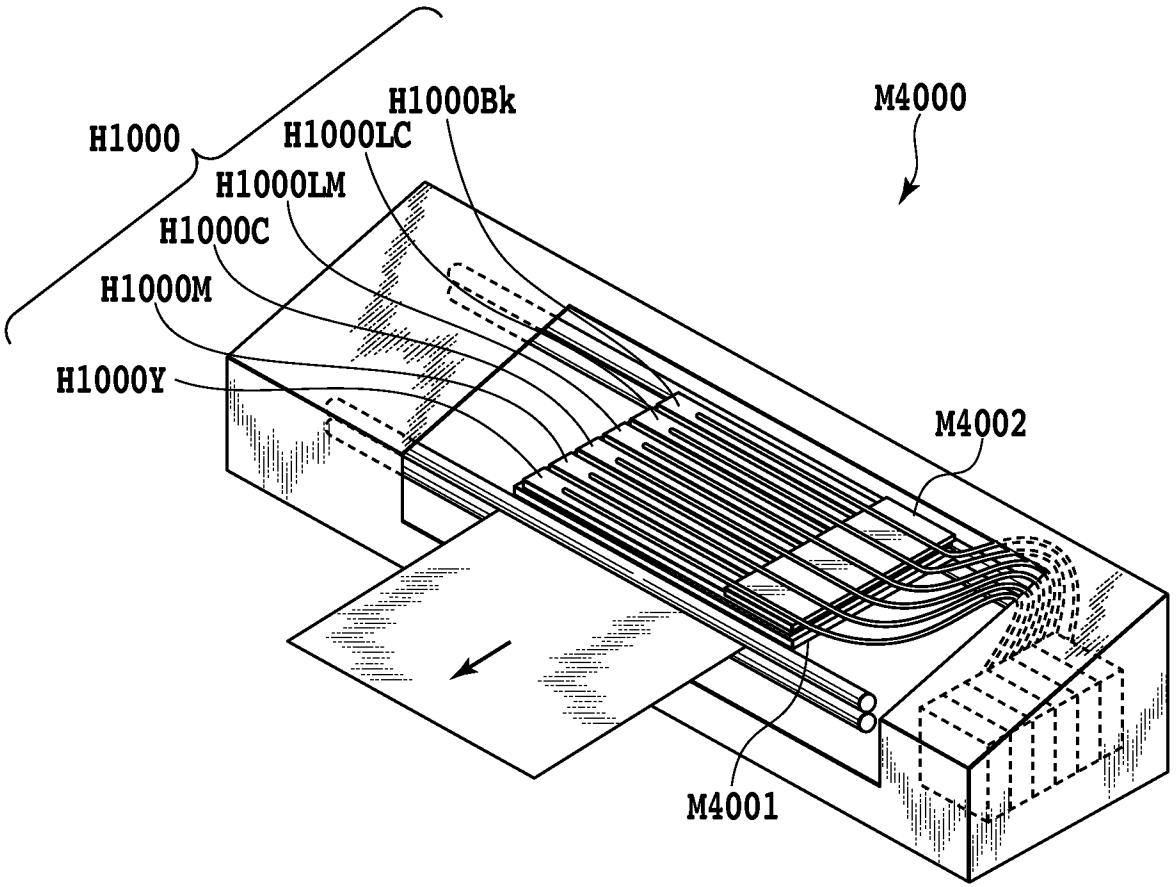
FIG. 5 illustrates a full-line-type inkjet printing apparatus.

The external signal input terminal H1301 of the printing element unit H1001 is positioned and fixed to the back face of the ink supply member H1500, for example. The inkjet printing apparatus M4000 according to an illustrative embodiment of the present invention includes, as shown in FIG. 5, printing heads for six colors in order to realize a photograph quality, for example. The printing head H1000Bk is a printing head for black ink. The printing head H1000C is for cyan ink. The printing head H1000M is for magenta ink. The printing head H1000Y is for yellow ink. The printing head H1000LC is for light cyan ink. The printing head H1000LM is for light magenta ink. These printing heads H1000 are fixedly supported by a positioning means and an electric contact M4002 of a printing head mount section M4001 provided on a printing apparatus main body M4000.

Figure 6:
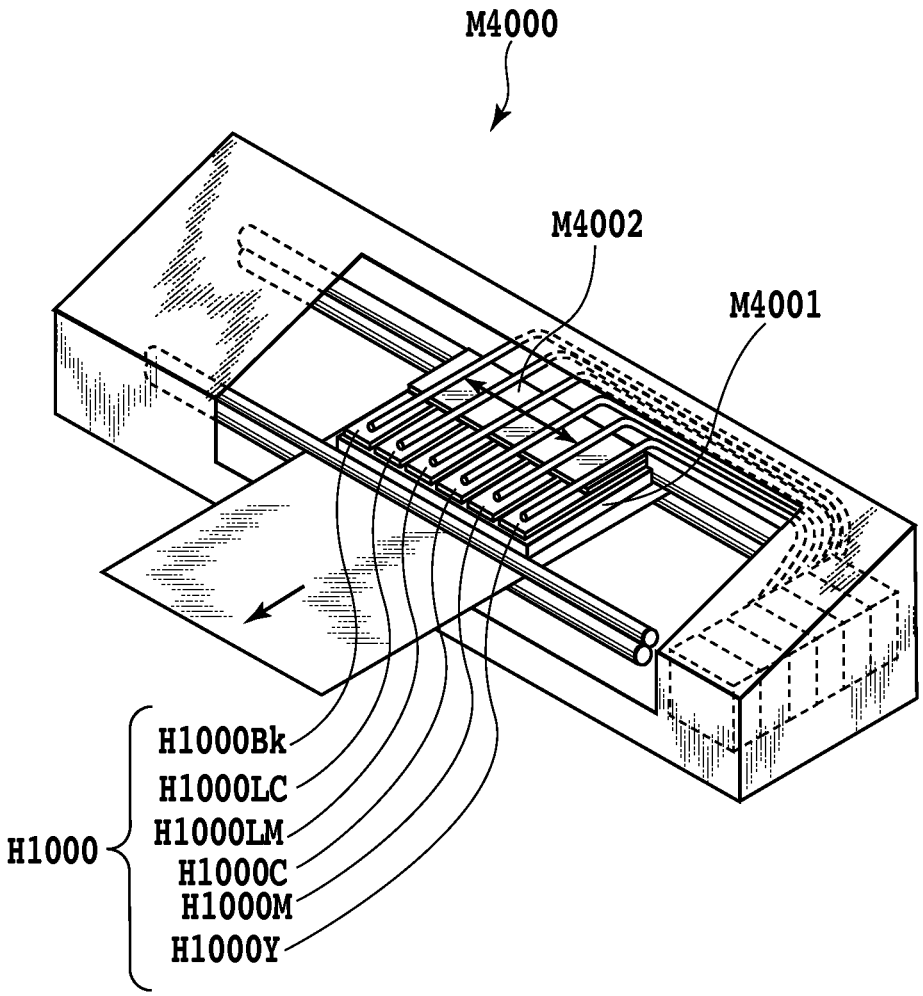
FIG. 6 illustrates a serial driving-type inkjet printing apparatus.

These printing heads H1000 are controlled by a not-shown driving circuit to subject a printing medium to a printing operation. The printing apparatus of FIG. 5 is the full-line type one in which a printing head has an ejection opening length corresponding to the width of a printing medium and the printing head is fixed and the printing medium is scanned in the direction shown by the arrow (while being carried by a carrier) to carry out a printing operation. On the other hand, the printing apparatus of FIG. 6 is a serial driving-type printing apparatus in which a printing head is provided on a carriage as the head mount section M4001 and a printing operation is performed while allowing the carriage to be reciprocated in the main scanning direction (carriage moving direction).

Next, the inkjet printing head of the present invention is structured so that a plurality of printing element substrates having ejection opening arrays consisting of a plurality of ejection openings for ejecting ink are arranged on the support plate along the direction of the ejection opening arrays. The inkjet printing head described in the following respective embodiments has a configuration in which the support plate includes therein a heat pipe.

(First Embodiment)

Figure 7A:
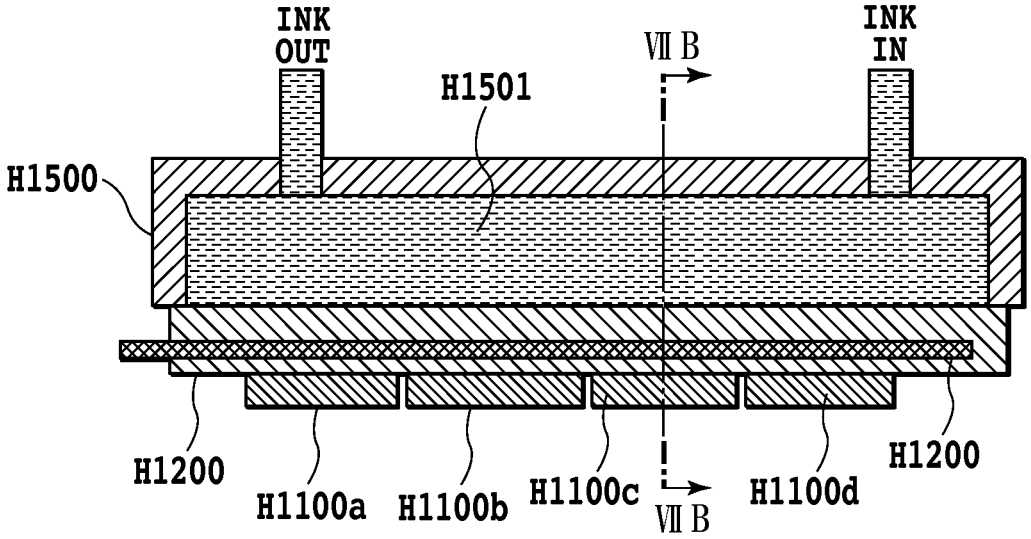
FIG. 7A is a longitudinal cross-sectional view illustrating a printing head according to the first embodiment of the present invention.
Figure 7B:
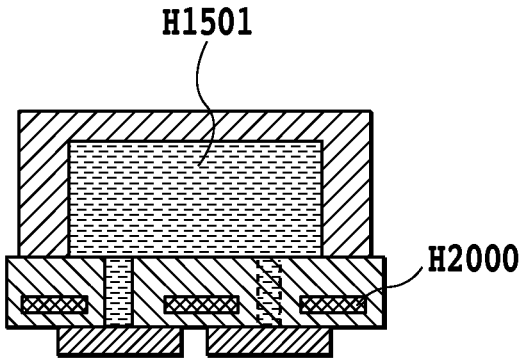
FIG. 7B is a lateral cross-sectional view taken along VIIB-VIIB of FIG. 7A.

FIG. 7A illustrates a longitudinal cross section of the inkjet printing head according to the first embodiment of the present invention. FIG. 7B is a lateral cross-sectional view taken along VII B-VII B. The support plate H1200 has thereon the four printing element substrates H1100*a*, H1100*b*, H1100*c*, and H1100*d* arranged in a staggered pattern.

Figure 8:
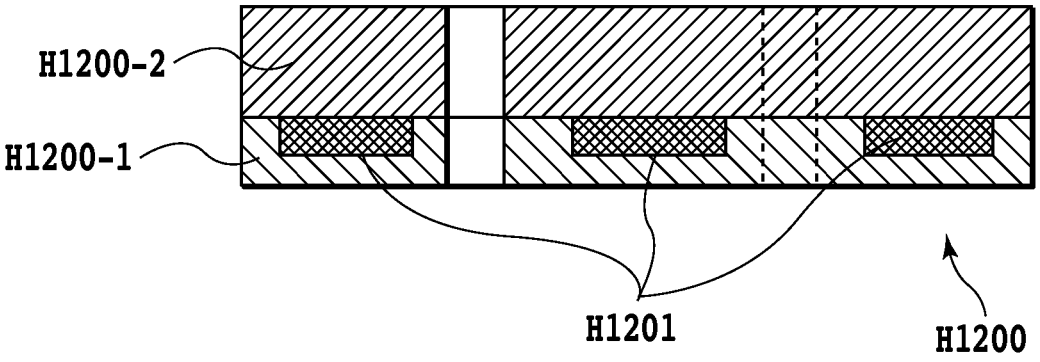
FIG. 8 is a schematic view illustrating only the support plate of FIG. 7B.

FIG. 8 is a schematic view illustrating only the support plate H1200 of FIG. 7B. The support plate H1200 is a single substrate composed of two plate-like members that are adhered to each other by adhesive agent. At the opposite side of a face of the first support plate H1200-1 on which the printing element substrate is provided, three grooves are formed independently. By adhering the second support plate H1200-2 to the first support plate H1200-1, the respective grooves are covered to provide a passage H2001, as a storage space in which the heat pipe H2000 is provided. The passage H2001 in which the heat pipe is provided has a cross section having a width of 4.2 mm and a depth of 2.2 mm. The passage H2001 includes therein the heat pipe H2000 having a flat cross-sectional shape of a width of 4 mm and a thickness of 2 mm. The gap between the passage H2001 and the heat pipe H2000 is filled by silicon adhesive agent to fix the heat pipe H2000 to the support plate H1200.

When only the heat pipe H2000 is provided, the printing head of the entire support plate H1200 can be soaked. Some conditions for executing a printing operation may not require the cooling of the support plate H1200. Thus, this may be effective for a printing operation that is not performed with a high speed but that requires a high definition.

When a continuous high speed printing is carried out, a cooling function also must be provided. Thus, as shown in FIG. 7A, one side of the heat pipe also can be extended by the support plate and can be coupled to a cooling member such as a heat sink. In this case, the printing head also can be soaked and cooled, thus providing a superior configuration. In this case, the printing apparatus must include therein a heat sink for example.

By the configuration as described above, the heat pipe H2000 can be provided in the vicinity of the printing element substrate as a heat source, thus reducing the temperature tolerance in the printing head.

The configuration in which the heat pipe coupled to a cooling member such as a heat sink also can suppress the temperature rise of the printing head.

(Second Embodiment)

Figure 9A:
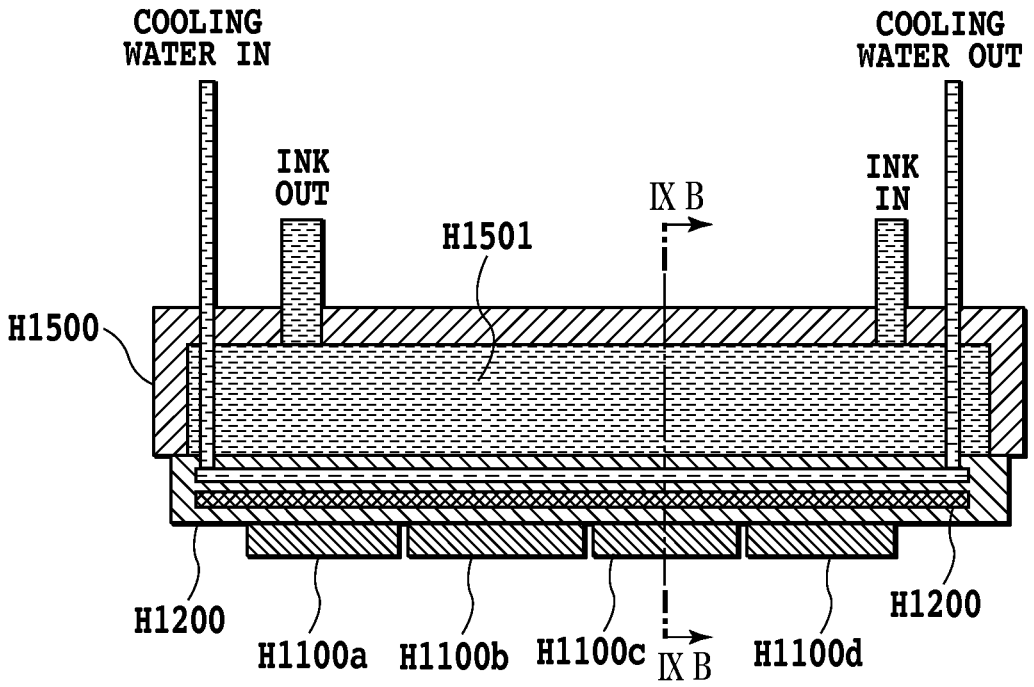
FIG. 9A illustrates a longitudinal cross section of an inkjet printing head according to the second embodiment of the present invention.
Figure 9B:
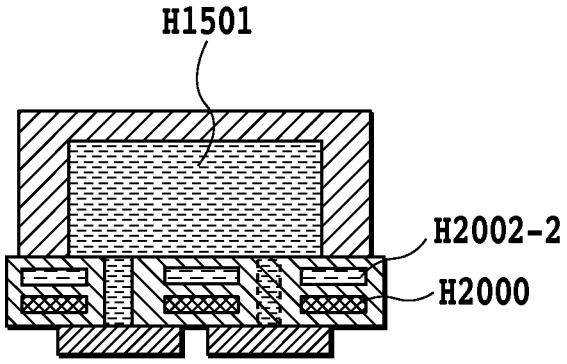
FIG. 9B is a lateral cross-sectional view taken along IXB-IXB of FIG. 9A.

FIG. 9A is a longitudinal cross section of the inkjet printing head according to the second embodiment of the present invention. FIG. 9B is a lateral cross-sectional view taken along IX B-IX B of FIG. 9A. In this embodiment, the support plate H1200 includes therein the heat pipe H2000 and a cooling medium flow path H2002-2. In this embodiment, the heat pipe H2000 is provided at the printing element substrate H1100 in the support plate H1200 and the heat pipe H2000 and the flow path H2002-2 are arranged in the thickness direction of the support plate H1200. In other words, the printing element substrate H1100, the passage, as a storage space in which the heat pipe H2000 is provided, and the flow path H2002-2 are provided in the listed order in the thickness direction of the support plate.

Figure 10:
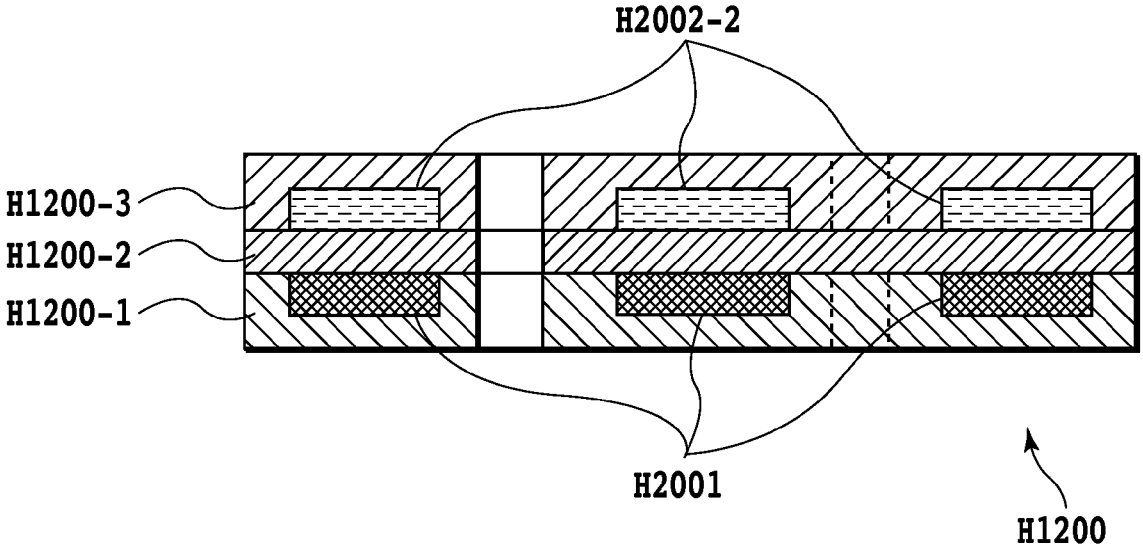
FIG. 10 and FIG. 11 are a schematic views illustrating a support plate in an inkjet printing head according to the third embodiment of the present invention.

FIG. 10 is a schematic view illustrating only the support plate H1200 of FIG. 9B. The support plate H1200 is composed of three members that are mutually adhered by adhesive agent to configure one substrate. At the opposite side of a face of the first support plate H1200-1 on which the printing element substrate is provided, three grooves are formed independently. By adhering the second support plate H1200-2 to the first support plate H1200-1, the respective grooves are covered to provide a passage H2001, as a storage space in which the heat pipe H2000 is provided. The third support plate H1200-3 also has three grooves formed independently. By adhering the third support plate H1200-3 to the second support plate H1200-2, the flow path H2002-2 is formed in which a cooling medium can be transported.

The groove in which the heat pipe is stored and the shape of the used heat pipe have the same structures as those of the above-described first embodiment. By filling the gap between the passage H2001, as a storage space and the heat pipe H2000 by silicon adhesive agent, the heat pipe H2000 is fixed to the support plate H1200. In this embodiment, the flow path H2002-2 has a cross section having a width of 3 mm and a depth of 2 mm. The cooling liquid is flowed in a flow rate from about 20 ml/min to about 100 ml/min. This flow rate may be an appropriate flow rate depending on the conditions for carrying out a printing operation and the specification of the printing head.

The heat pipe H2000 may be a commercially-available heat pipe. The heat pipe H2000 may have any shape so long as the shape can allow the heat pipe H2000 to contact with the support plate H1200 in a sufficient contact area. In view of the processibility of the groove and the structure of the printing head, the heat pipe is preferably formed to have a flat shape. The gap between the heat pipe H2000 and the support plate H1200 may be filled by material that has a high thermal conductivity and that is stable. Such material may be silicon-base adhesive agent.

The support plate H1200 is preferably made of material that has ink resistance and that has a high heat conduction including ceramic material, carbon graphite material or the like. Among ceramic materials, alumina in particular is relatively low-cost and rigid and thus is optimal for a long printing head for which the disadvantageous warpage or waviness of the printing head is easily caused. An alumina substrate obtained by layering and burning green sheets is preferred because the alumina substrate can be manufactured with a low cost for the complicated structure as in the present invention. Thus, the heat pipe can be provided without using adhesive agent as an insulating member and thus is more preferred from the viewpoint of the cooling and soaking of the printing head.

The heat pipe H2000 and the cooling flow path H2004 in the support plate H1200 are preferably provided to be close to the printing element substrate H1100 as a heat source as much as possible. It is necessary that the temperature distribution of the support plate H1200 partially increased due to the temperature rise of the printing element substrate H1100 is soaked by the heat pipe H2000 with a high heat transfer efficiency and can be cooled by cooling liquid. Thus, such a configuration is preferred in which the heat pipe H2000 is close to the printing element substrate H1100 in the support plate H1200 as much as possible and a partition layer is sandwiched therebetween to form a cooling flow path.

The configuration as described above can reduce the temperature tolerance in the printing head and can suppress a temperature rise. Thus, even when the electric heat conversion elements H1102 are arranged with a high density to perform a printing operation with a high speed, a partially-uneven concentration or an ejection failure can be reduced and a high-quality image can be printed with a high speed.

When compared with the cooling by the heat sink as in the first embodiment, the configuration as in this embodiment using both of the heat pipe and the cooling flow path can provide a higher cooling efficiency and thus is optimal.

The cooling medium preferably used in the present invention may be water, ink, air, and nitrogen gas, for example. The circulation of a medium having an adjusted temperature in particular can realize easy management and control of the temperature. When the cooling flow path is divided into a plurality of paths, the temperature of the printing head can be finely controlled by the direction along which the cooling liquid is flowed or the number of used flow paths.

Figure 13:
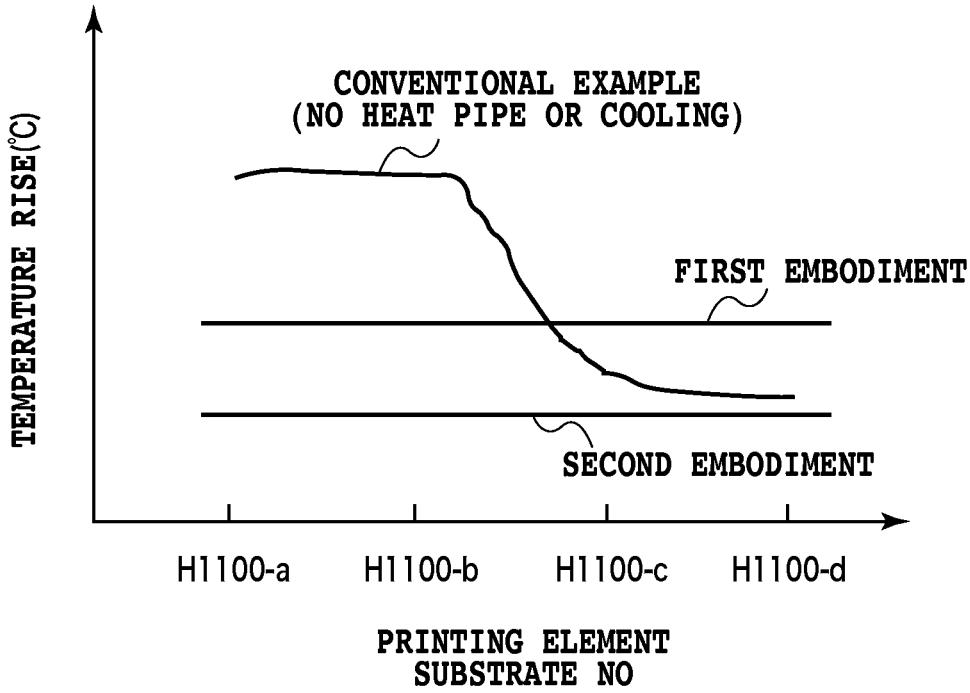
FIG. 13 is a graph illustrating printing head temperatures of the printing heads of the first and second embodiments of the present invention and a conventional inkjet printing head.

FIG. 13 is a graph illustrating the temperature rises of the printing heads of the first and second embodiments of the present invention and a conventional inkjet printing head having no heat pipe or cooling immediately after a borderless and entire printing operation to 50 A4-size papers. Among the four chips of the used printing element substrate H1100, only H1100-*a* and H1100-*b* were used; H1100-*c* and H1100-*d* were not used. According to this test, the printing element substrates of H1100-*a* and H1100-*b* of the conventional inkjet printing head reached a high temperature and the temperature of the printing head continuously increased to finally cause an ejection failure. In the case of the inkjet printing head using the present invention on the other hand, the used printing element substrates H1100-*a* and H1100-*b* as well as the not-used printing element substrates H1100-*c* and H1100-*d* were soaked to have substantially the same temperature and showed a temperature rise that is about a half of the temperature rise of the conventional inkjet printing head when about 50 papers were printed. When the printing operation was still continued, no ejection failure was caused.

The temperature rise ($\Delta T$) changes depending on the heat transport amount of a heat pipe, the shape of a cooling groove, the flow rate of cooling water, or a temperature. Thus, optimal conditions are provided by the specification such as the arrangement of electric heat conversion elements of the used inkjet printing head or the ejection amount.

(Third Embodiment)

Figure 11:
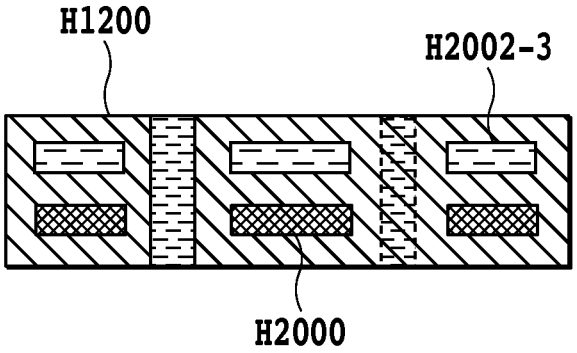

FIG. 11 is a schematic view illustrating the support plate H1200 in the inkjet printing head according to the third embodiment of the present invention. The third embodiment is different from the second embodiment in that the alumina support plate H1200 of the inkjet printing head is changed to a layered structure obtained by layering and burning green sheets. This configuration eliminates the need to adhere the support plate H1200 by adhesive agent having a poor thermal conductivity. Thus, the substrate can be made only of alumina having a high thermal conductivity. Thus, when compared with the second embodiment, the third embodiment can suppress the temperature rise of the printing head.

(Fourth Embodiment)

Figure 12:
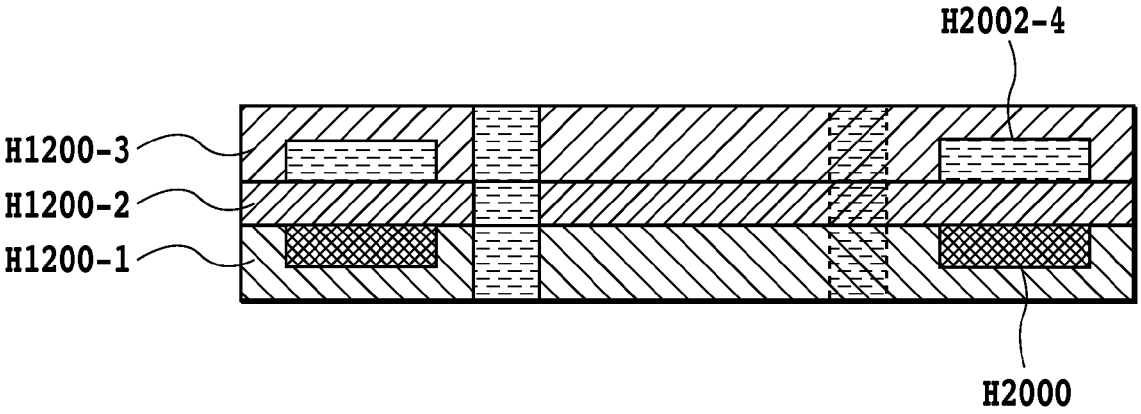
FIG. 12 is a schematic view illustrating a support plate in an inkjet printing head according to the fourth embodiment of the present invention.

FIG. 12 is a schematic view illustrating the support plate H1200 in the inkjet printing head according to the fourth embodiment of the present invention. The fourth embodiment reduces the number of the heat pipes and cooling flow paths to two heat pipes and two cooling flow paths, respectively. This reduction can provide, although the heat transfer efficiency is lowered, a simple flow path system and thus can provide a smaller printing head and a lower cost.

(Fifth Embodiment)

Figure 14A:
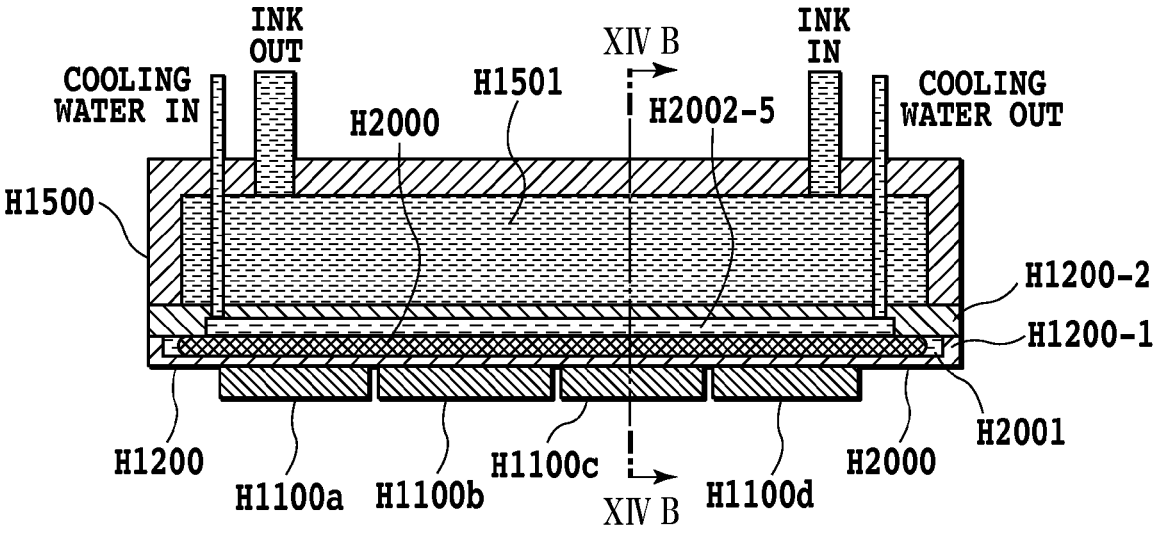
FIG. 14A is a longitudinal cross-sectional view illustrating a printing head of the fifth embodiment.
Figure 14B:
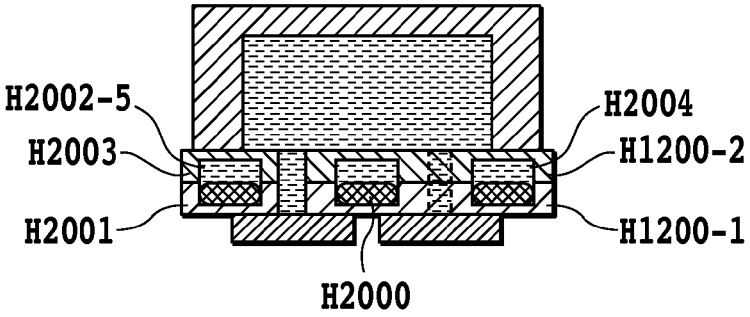
FIG. 14B illustrates a lateral cross section taken along B XIV B-XIV B of FIG. 14A.

FIG. 14A is a longitudinal cross-sectional view illustrating the printing head of this embodiment. FIG. 14B illustrates a lateral cross section taken along XIV B-XIV B of FIG. 14A. The support plate H1200 includes the four printing element substrates H1100*a*, H1100*b*, H1100*c*, and H1100*d* arranged in a staggered pattern.

The support plate H1200 is composed of two members that are mutually adhered by adhesive agent. At the opposite side of a face of the first support plate H1200-1 on which the printing element substrate is provided, three grooves are formed independently. By adhering the second support plate H1200-2 to the first support plate H1200-1, the passage H2001, as a storage space is formed in which the heat pipe H2000 is provided. The groove for storing the heat pipe has a cross section having a width of 4.2 mm and a depth of 2.2 mm. A flat heat pipe having a cross-sectional shape of a width of 4 mm and a thickness of 2 mm was fixed by silicon adhesive agent to the bottom face and the side face of the groove H2001, as a storage space in which the heat pipe H2000 is provided. Specifically, the cross-sectional area of the heat pipe in the direction along which a plurality of printing element substrates are arranged is smaller than the cross-sectional area of a passage in which the heat pipe is provided.

At the lower face of the second support plate H1200-2, a position opposed to the groove H2001 has three grooves H2002-5 formed independently along the direction of the ejection opening arrays (i.e., the direction along which the electric heat conversion element H1102 is arranged). This groove also has a cross section having a width of 4.2 mm and a depth of 2.2 mm. At the lower side of the passage H2003 formed of the groove H2001 and the groove H2002-5, the heat pipe H2000 is provided as described above.

On the other hand, the heat pipe H2000 is provided in a position close to the printing element substrate H1100 in the passage H2003 formed of the groove H2001 and the groove H2002-5. The passage H2003 has a space of a height slightly higher than 2 mm in the upper side of the heat pipe H2000. Through this space, cooling liquid such as water can be flowed, for example. Specifically, the space that is in the passage H2003 formed by the two grooves H2001 and H2002-5 and that does not include therein the heat pipe H2000 functions as a cooling liquid flow path (cooling flow path) H2004. In other words, the printing element substrate H1100, the passage H2003, and the cooling flow path H2004 are provided in the listed order in a thickness direction of the support plate. In this manner, the heat pipe H2000 and the cooling flow path H2004 are provided in the support plate H1100 along the direction of the ejection opening array (the direction along which the electric heat conversion element H1102 is arranged).

The cooling liquid flow rate is about 20 ml/min to 100 ml/min. An optimal flow rate may be selected depending on the condition for carrying out a printing operation or the specification of the printing head. The configuration as shown in FIG. 14 is preferred in which the heat pipe H2000 is provided to be close to the printing element substrate H1100 in the support plate H1200 as much as possible to form the cooling flow path H2004 so that the heat pipe H2000 can be directly cooled.

In this embodiment, the heat pipe is directly cooled by cooling liquid. Thus, a higher cooling effect can be achieved when compared with the configuration in which the heat pipe and the cooling flow path are provided independently.

Figure 15:
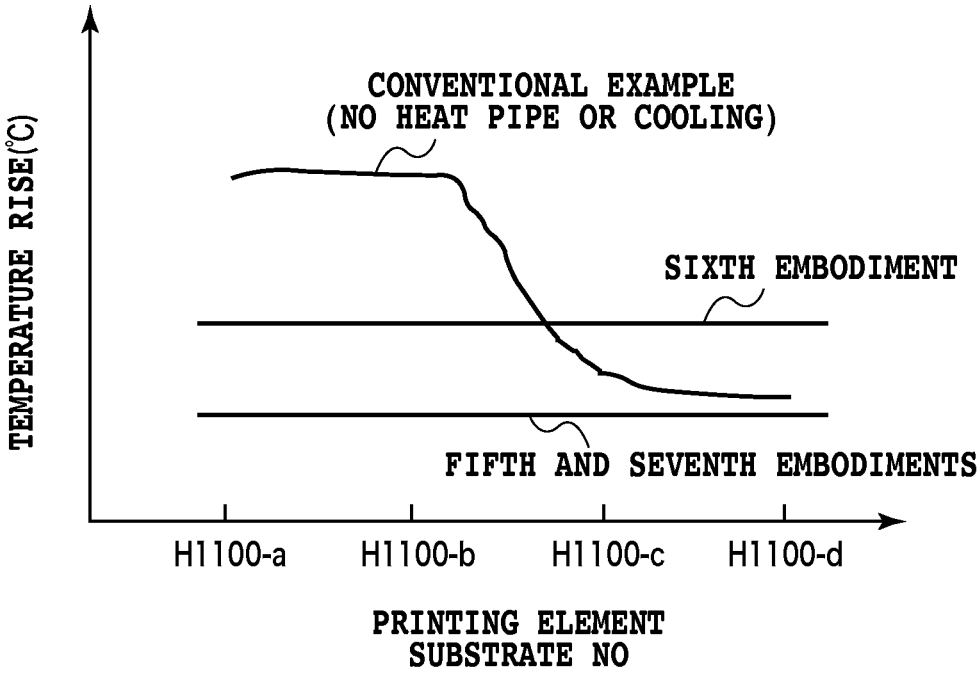
FIG. 15 is a graph illustrating the printing head temperatures of the printing heads of the fifth to seventh embodiments of the present invention and the conventional inkjet printing head.

FIG. 15 is a graph illustrating the printing head temperatures (temperature rises) of the printing heads of the fifth to seventh embodiments of the present invention and the conventional inkjet printing head having no heat pipe or cooling immediately after a borderless and entire printing operation to 50 A4-size papers. Among the four chips of the used printing element substrate H1100, only H1100-*a* and H1100-*b* were used; H1100-*c* and H1100-*d* were not used. According to this test, the printing element substrates of H1100-*a* and H1 100-*b* of the conventional inkjet printing head reached a high temperature and the temperature of the printing head continuously increased to finally cause an ejection failure. In the case of the inkjet printing head using the present invention on the other hand, the used printing element substrates H1100-a and H1100-*b* as well as the not-used printing element substrates H1100-*c* and H1100-*d* were soaked to have substantially the same temperature and showed a temperature rise that is about a half of the temperature rise of the conventional inkjet printing head when about 50 papers were printed. When the printing operation was still continued, no ejection failure was caused.

(Sixth Embodiment)

Figure 16:
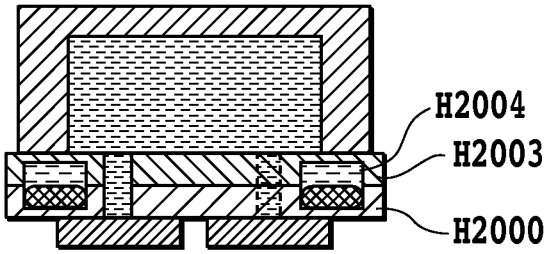
FIG. 16 is a cross-sectional view illustrating the printing head of the sixth embodiment.

FIG. 16 is a cross-sectional view illustrating the printing head of this embodiment. The inkjet printing head of the sixth embodiment is different from the fifth embodiment in that the number of the passages H2003 passing through the heat pipe H2000 and the cooling flow path H2004 is reduced. The inkjet printing head of the sixth embodiment has the same configuration as that of the fifth embodiment including a point that a flow path for cooling a heat pipe is provided in the support plate along the direction of the ejection opening array (the direction along which the electric heat conversion element is arranged). The reduction of the number of the passages H2003 from three to two can provide, although the heat transfer efficiency is lowered, a simple flow path system and thus can provide a smaller printing head and a lower cost.

As shown in FIG. 15, in the case of the inkjet printing head of this embodiment, the temperature was saturated when the 50 papers were printed. Even when the printing operation was continued thereafter, the printing head showed no temperature rise. A difference in the temperature in the direction of the length of the printing head also could be suppressed to a level causing no problem.

(Seventh Embodiment)

Figure 17:
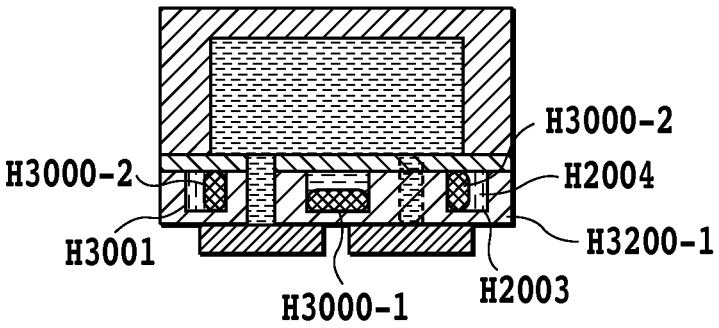
FIG. 17 is a cross-sectional view illustrating the printing head of the seventh embodiment.

FIG. 17 is a cross-sectional view illustrating the printing head of this embodiment. The printing head of this embodiment is structured so that two heat pipes at both sides of each of three routes of the fifth embodiment has an elongated cross section (in a direction close to the printing element substrate). The inkjet printing head of the seventh embodiment has the same configuration as that of the fifth embodiment including a point that a flow path for cooling a heat pipe is provided in the support plate along the direction of the ejection opening array (the direction along which the electric heat conversion element is arranged). Specifically, in the seventh embodiment, a flat outer periphery face of the heat pipe H3000-2 is abutted to the inner side face of the groove H3001 of the support plate H3200-1. The configuration as described above can reduce the width in the shorter direction of the head (a direction crossing the ejection opening array).

As shown in FIG. 15, the inkjet printing head of this embodiment could provide substantially the same temperature rise characteristic as that of the inkjet printing head of the fifth embodiment.

(Eighth Embodiment)

Figure 18A:
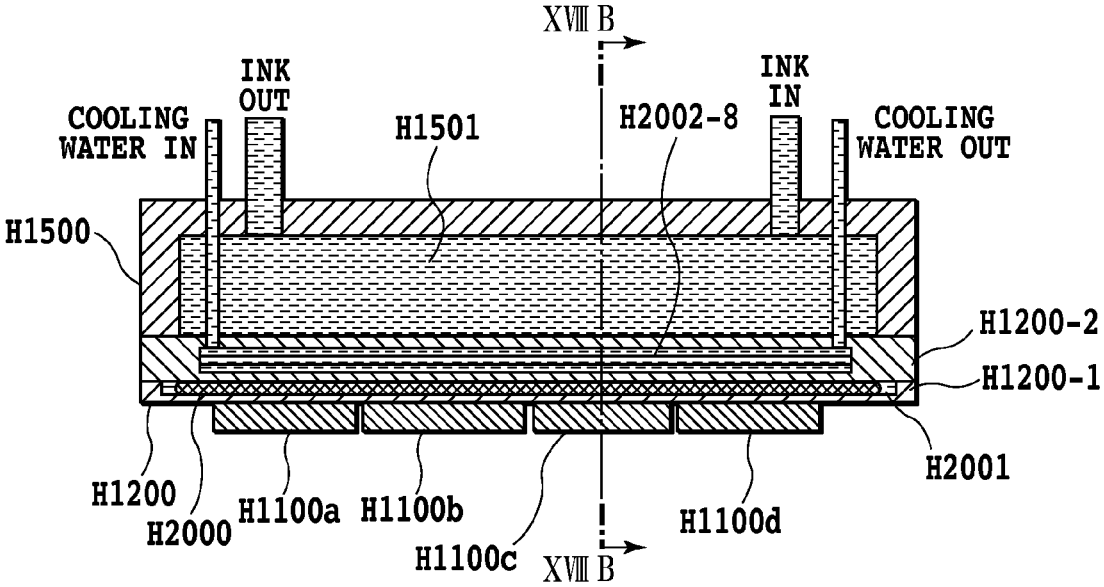
FIG. 18A is a longitudinal cross-sectional view illustrating the printing head of the eighth embodiment.
Figure 18B:
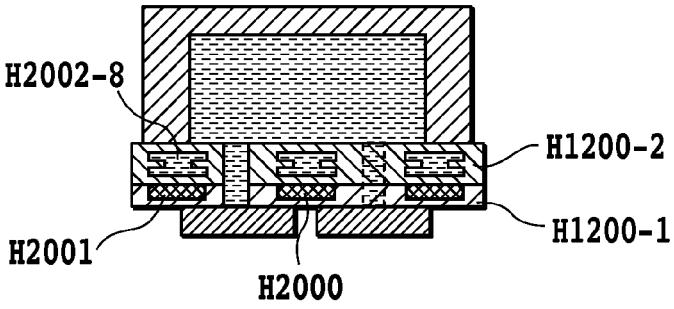
FIG. 18B is a lateral cross-sectional view taken along XVIII B-XVIII B of FIG. 18A.

FIG. 18A is a longitudinal cross-sectional view illustrating the printing head of this embodiment. FIG. 18B is a lateral cross-sectional view taken along XVIII B-XVIII B of FIG. 18A. The printing head of this embodiment is structured so that the inner surface of the cooling medium flow path H2002-8 of the printing head of the second embodiment is shaped to have concavities and convexities. In other words, a cross section of the cooling medium flow path H2002-8 in the arranging direction of the plurality of printing element substrates has a concave shape. The second the support plate H1200-2 is composed of an alumina substrate obtained by layering and burning green sheets as described above. Thus, the complicated shape of concavities and convexities can be manufactured with a low cost.

By the cross section of the flow path H2002-8 having the concave shape, the surface area can be increased to provide a higher cooling effect in a limited space.

(Ninth Embodiment)

Figure 19A:
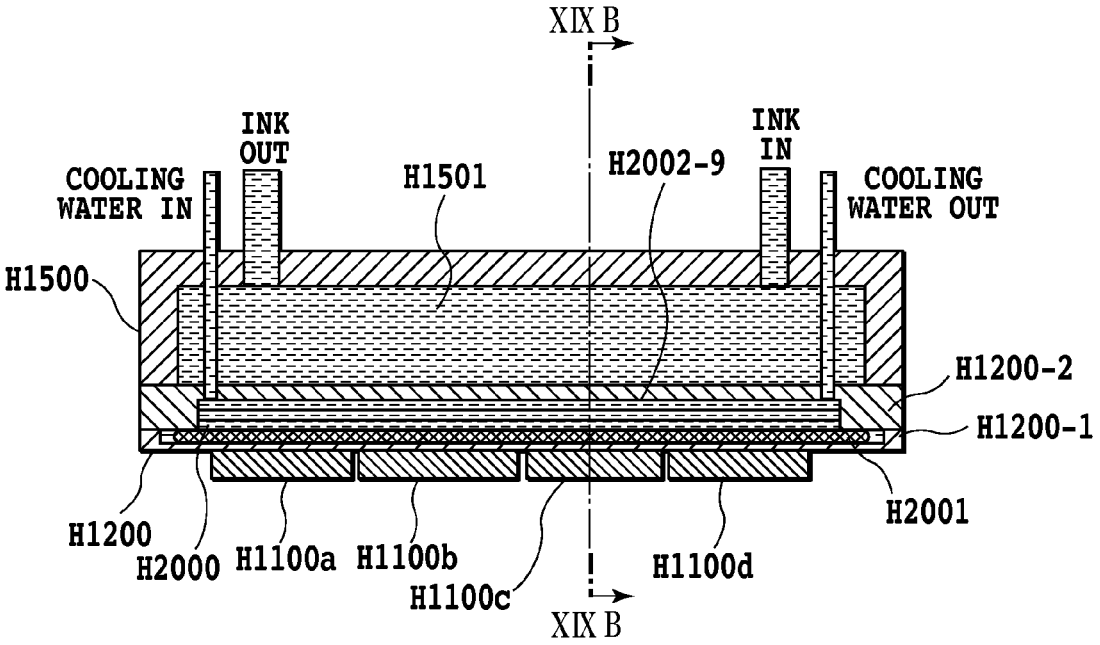
FIG. 19A is a longitudinal cross-sectional view illustrating the printing head of the ninth embodiment.
Figure 19B:
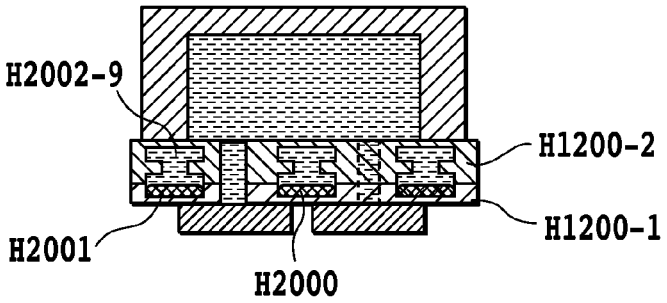
FIG. 19B is a lateral cross-sectional view taken along XIX B-XIX B of FIG. 19A.

FIG. 19A is a longitudinal cross-sectional view illustrating the printing head of this embodiment. FIG. 19B is a lateral cross-sectional view taken along XIX B-XIX B of FIG. 19A. The printing head of this embodiment is structured so that the inner surface of the cooling medium flow path H2002-9 in the printing head of the fifth embodiment includes concavities and convexities. By the flow path H2002-9 shaped to have the cross section including concavities and convexities as described above, the surface area can be increased to provide a higher cooling effect in a limited space. As in the eighth embodiment, the second support plate H1200-2 is composed of an alumina substrate obtained by layering and burning green sheets as described above. Thus, the complicated shape of concavities and convexities can be manufactured with a low cost.

In this embodiment, the heat pipe is directly cooled by cooling liquid. Thus, a higher cooling effect can be provided when compared with the eighth embodiment.

Figure 20:
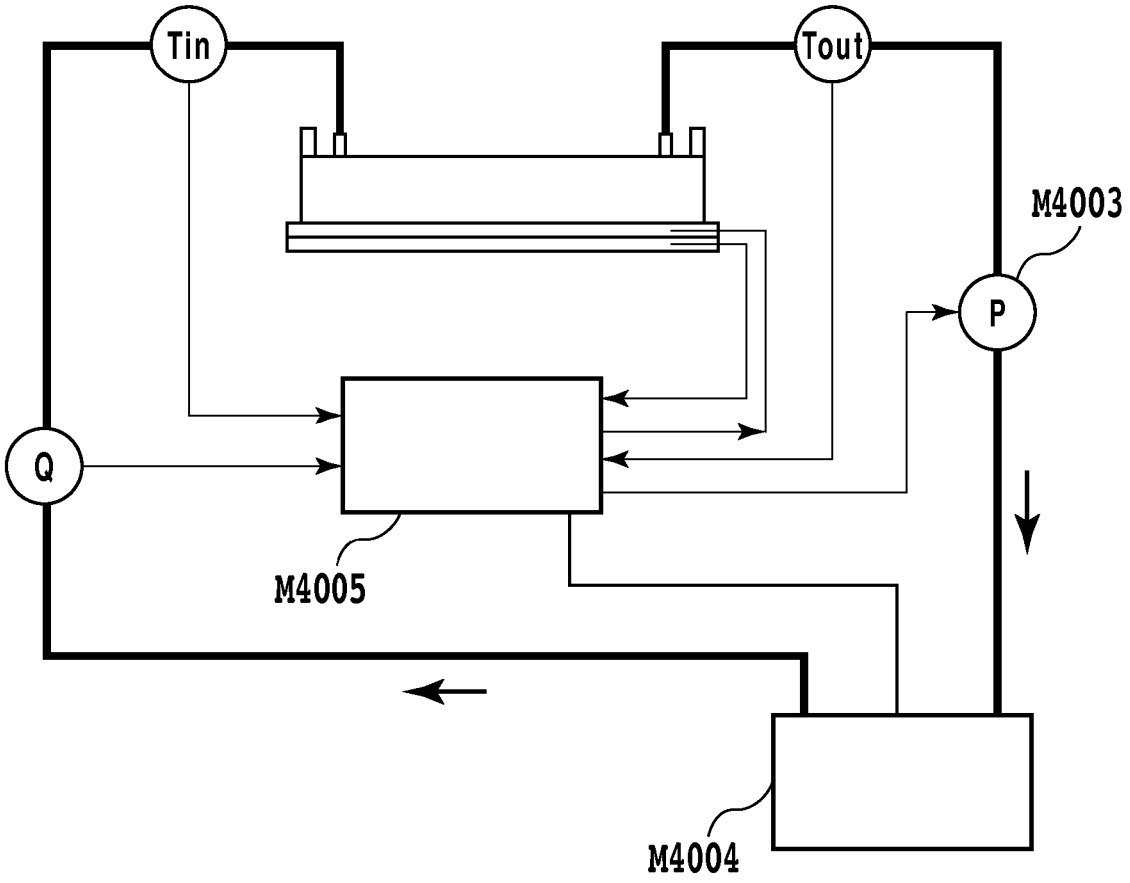
FIG. 20 illustrates one example of a liquid circulation system of a cooling system used in the respective embodiments of the present invention.

FIG. 20 shows one example of a liquid circulation system of a cooling system used in the respective embodiments of the present invention. Cooling water is sent by a pump M4003 to the cooling liquid supply opening of the printing head and is returned to a constant temperature bath M4004 through the cooling flow path in the head, for example. A control apparatus M4005 flows cooling liquid in the cooling flow path of the printing head, for example, to control the printing head so as to suppress the temperature rise of the printing head. This control apparatus M4005 sets cooling conditions based on conditions such as the flow rate of cooling water, an inlet temperature, an outlet temperature, a head temperature (e.g., a sensor in the printing element substrate), detected data such as an environment temperature, an exhaust heat amount by the cooling liquid from the head, or printing conditions to control the head temperature. Specifically, at least one of the direction along which liquid flows, a fluid temperature, and the flow rate can be controlled to suppress the temperature rise and uneven temperature distribution of the printing head more effectively.

When printing liquid is used as a cooling medium, only a single tank can be used unlike methods using other media. Thus, the printing apparatus can have a smaller size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-309698, filed Nov. 30, 2007, 2007-311415, filed Nov. 30, 2007, 2007-309700, filed Nov. 30, 2007 and 2008-283334, filed Nov. 4, 2008 which are hereby incorporated by reference herein in their entirety.

What is claimed is:

1. An inkjet printing head, comprising:

a printing element substrate that includes a plurality of ejection openings for ejecting ink and includes a plurality of elements for generating thermal energy for ejecting ink from the plurality of ejection openings;

a support plate for supporting the printing element substrate;

a heat pipe that is provided in a direction along an arranging direction of the plurality of ejection openings; and a flow path inside which cooling liquid flows, the flow path having an inlet through which cooling liquid flows in, and an outlet through which cooling liquid flows out, the flow path being provided in a direction along the arranging direction, wherein the printing element substrate, the heat pipe, and the flow path are provided in the listed order in a thickness direction of the support plate.

2. The inkjet printing head according to claim 1, wherein the heat pipe and the flow path are respectively provided in the support plate independently.

3. The inkjet printing head according to claim 1, wherein with regard to cross-sections in the arranging direction, the heat pipe has a cross-sectional area smaller than a cross-sectional area of the a passage in which the heat pipe is provided, and a portion of the passage other than a portion in which the heat pipe is provided is used as the flow path.

4. The inkjet printing head according to claim 1, wherein the support plate is made of ceramic.

5. The inkjet printing head according to claim 1, wherein the support plate is formed by layering green sheets and burning the layered green sheets.

6. The inkjet printing head according to claim 1, wherein a cross-section of the flow path in the arranging direction has a concave shape.

7. The inkjet printing head according to claim 1, further comprising a plurality of printing element substrates, wherein the plurality of printing element substrates are arranged in a staggered pattern on the support plate.

8. An inkjet printing head according to claim 1, wherein the heat pipe and the flow path are provided in the support plate.

9. The inkjet printing head according to claim 1, wherein the heat pipe and the flow path are in contact with each other.

10. An inkjet printing apparatus comprising:

an inkjet printing head including a printing element substrate that includes a plurality of ejection openings for ejecting ink and includes a plurality of elements for generating thermal energy for ejecting ink from the plurality of ejection openings, a support plate for supporting the printing element substrate, a heat pipe that is provided in a direction along an arranging direction of the plurality of ejection openings, a flow path inside which cooling liquid flows, the flow path having an inlet through which cooling liquid flows in, and an outlet through which cooling liquid flows out, the flow path being provided in a direction along the arranging direction, wherein the printing element substrate the heat Si, e and the flow path are provided in the listed order in a thickness direction of the support plate; and a unit for causing flow of the cooling liquid in the flow path.

* * * * *